US009392828B2

(12) United States Patent
Esagoff

(10) Patent No.: US 9,392,828 B2
(45) Date of Patent: Jul. 19, 2016

(54) WEARABLE POCKET

(71) Applicant: Mojgan Esagoff, Beverly Hills, CA (US)

(72) Inventor: Mojgan Esagoff, Beverly Hills, CA (US)

( * ) Notice: Subject to any disclaimer, the term of this patent is extended or adjusted under 35 U.S.C. 154(b) by 26 days.

(21) Appl. No.: 14/209,734

(22) Filed: Mar. 13, 2014

(65) Prior Publication Data

US 2014/0259298 A1 Sep. 18, 2014

Related U.S. Application Data

(60) Provisional application No. 61/852,421, filed on Mar. 15, 2013, provisional application No. 61/938,645, filed on Feb. 11, 2014.

(51) Int. Cl.
*A41D 27/20* (2006.01)
*A44C 3/00* (2006.01)

(52) U.S. Cl.
CPC ..... *A41D 27/20* (2013.01); *A44C 3/001* (2013.01); *A44D 2203/00* (2013.01)

(58) Field of Classification Search
CPC ..... A41D 27/20; A41D 27/201; A41D 27/08; A41D 13/0012; A45C 13/08; G09F 3/00; A44C 1/00; A44C 25/00; A44B 17/0082; A44B 1/04
USPC ..... 2/251, 247, 252, 249, 244, 246
See application file for complete search history.

(56) References Cited

U.S. PATENT DOCUMENTS

| | | | | |
|---|---|---|---|---|
| 5,369,899 | A * | 12/1994 | Reeves | 40/1.5 |
| 6,175,963 | B1 * | 1/2001 | Loeffelholz | 2/209.13 |
| 2005/0144704 | A1 * | 7/2005 | Vitallo | 2/247 |
| 2005/0167485 | A1 * | 8/2005 | Taras | 235/380 |
| 2008/0023508 | A1 * | 1/2008 | Harchol | 224/183 |
| 2010/0005693 | A1 * | 1/2010 | Craycroft et al. | 40/360 |
| 2012/0317702 | A1 * | 12/2012 | Daly et al. | 2/265 |
| 2013/0227764 | A1 * | 9/2013 | DiDavide | 2/247 |
| 2013/0247279 | A1 * | 9/2013 | Castillo | 2/255 |

* cited by examiner

*Primary Examiner* — Andrew W Collins
(74) *Attorney, Agent, or Firm* — Payam Moradian

(57) ABSTRACT

Provided is a wearable pocket that can be inside clothing through a magnetic connection with a button on outside of the clothing.

9 Claims, 3 Drawing Sheets

FIG. 6
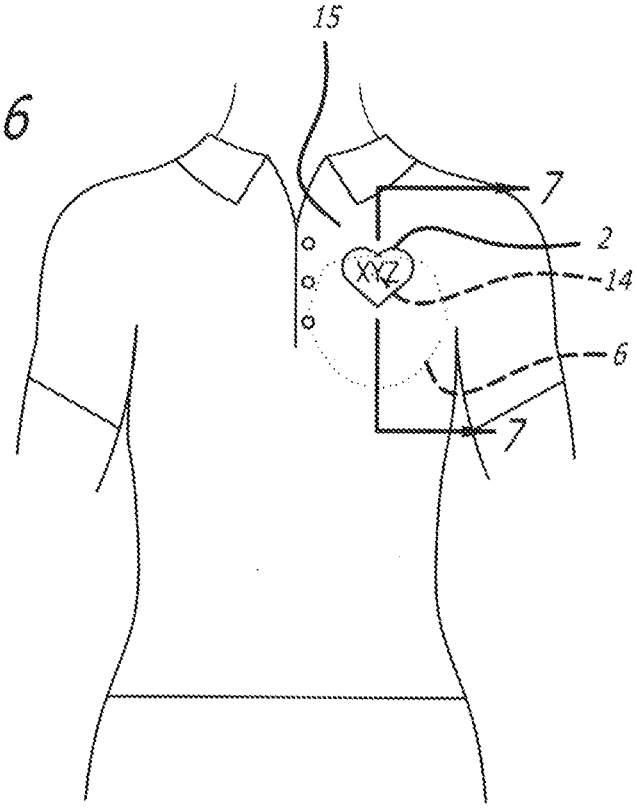
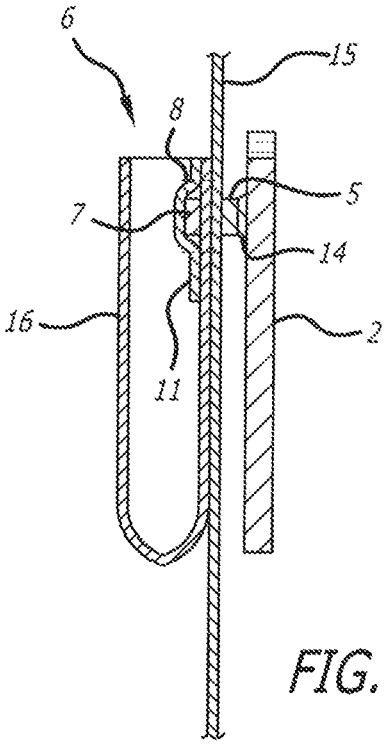
FIG. 7
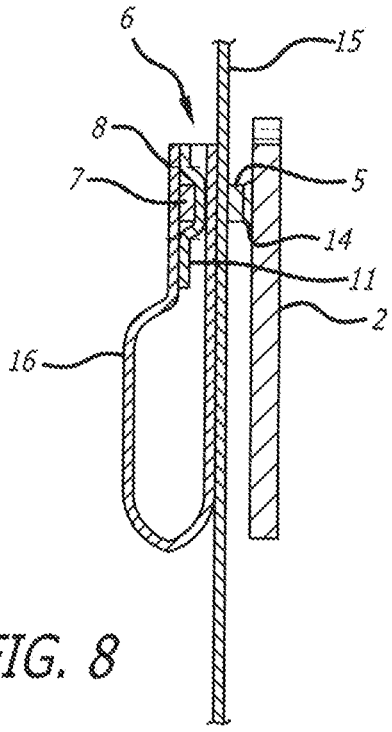
FIG. 8

WEARABLE POCKET

CROSS-REFERENCE

The present application claims the benefit of provisional Application No. 61/852,421 filed on Mar. 15, 2013 and provisional application No. 61/938,645, filed on Feb. 11, 2014, both of which are incorporated herein by reference in their entirety.

BACKGROUND SECTION OF THE INVENTION

Small objects like cigarettes, condoms, pills, money, credit card, notes, and papers are difficult to carry. There is a need in the art for a pocket to carry small objects.

SUMMARY SECTION OF THE INVENTION

Provided is a package comprising: a) a button with a first magnet for placing outside of an article of clothing; and b) a wearable pocket with a second magnet for placing inside of the clothing; wherein the first and the second magnet form a magnetic connection through the clothing to maintain the button and the wearable pocket on the clothing. The clothing can be a shirt, dress, jacket, underwear, or skirt. The button can have a design element. The button can have a side facing the pocket, the side facing the pocket having a raised disc for placing the first magnet. The pocket can have a sewn compartment for placement of the second magnet. The compartment can have sufficient space to allow for the second magnet to be flipped. The compartment can have a square in shape. The pocket can have an opening solely at its top. The pocket can be made from a piece of fabric that is folded to create a bottom, two sides, and a top, with the two sides sewn, and the top flipped over and sewn to create a compartment for placement of the second magnet. The pocket can have a second magnet that is held in place by sewing a piece of fabric on the pocket to create a compartment for the second magnet. At least a portion of the pocket holding the second magnet can be made from a fabric with fusing.

Provided is a method of carrying objects comprising: a) placing a button with a first magnet outside of an article of clothing; b) placing an object in a wearable pocket; c) placing the wearable pocket with a second magnet inside the clothing; and d) forming a magnetic connection between the first and the second magnet. The method can comprise the step of flipping the magnet in the pocket.

Provided is a method for manufacturing a wearable pocket comprising: a) sewing a pocket having an inside and an outside; b) sewing an additional fabric piece with a fusing to the inside of the pocket to create a compartment for a magnet, c) placing the magnet in the compartment; d) sewing the compartment to seal the compartment.

BRIEF DESCRIPTION OF THE INVENTION

FIG. 6 illustrates a front view of person wearing the wearable pocket on a shirt.

FIG. 7 illustrates a side view of a cut-off of FIG. 6, where the magnet is on the side of the pocket that is away from the user.

FIG. 8 illustrates a side view of a cut-off of FIG. 6, where the magnet is on the side of the pocket that is towards the user.

DETAILED DESCRIPTION OF THE INVENTION

Figure 1:
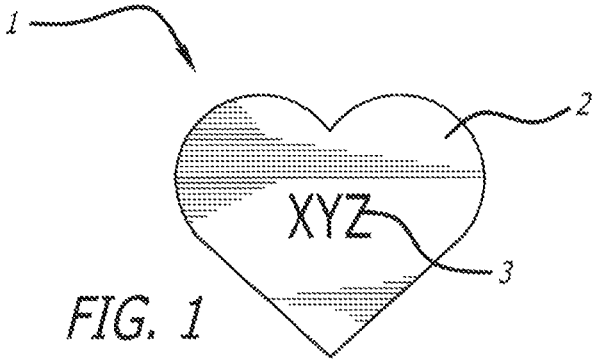
FIG. 1 illustrates a front view of a button.

Provided is a wearable pocket (6) with a magnet (7) for placement under a piece of clothing (15), which is connected through the magnet (7) to a button (1) with a magnet (5) that is placed on the outside of the clothing (15). The clothing (15) can be a shirt (15), dress, jacket, underwear, or any suitable clothing for the upper body. The wearable pocket (6) can also be used for other types of clothing like a skirt or an apron, and can be attached to clothing worn in the lower portion of the body as well.

Figure 2:
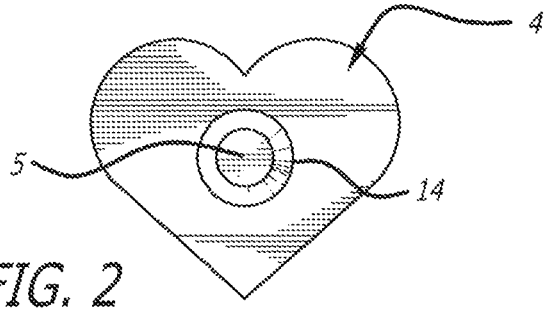
FIG. 2 illustrates a back view of a button.

FIG. 1 illustrates a button (1) having a front body (2) and a design element (3), which in this case is a text. FIG. 2 illustrates the back of the button (4) with magnet (5) attached. The magnet (5) can be placed inside a raised disc (14) to securely hold the magnet (5). The attachment of the magnet (5) can be with glue. In this embodiment, the button (1) is in the shape of a heart. In other embodiments, the button (1) can be any suitable shape (such as a flag) or even made of clear non-visible material.

Figure 3:
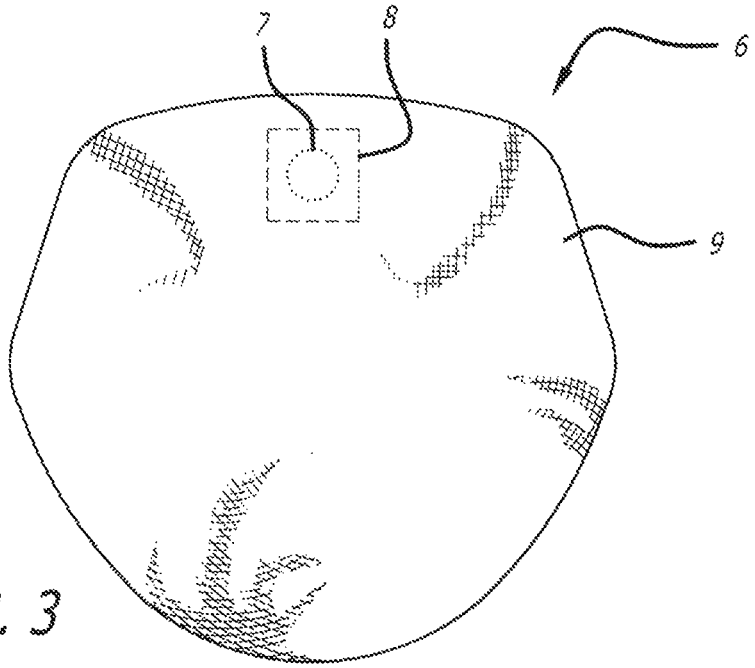
FIG. 3 illustrates a front view of the wearable pocket.

FIG. 3 illustrates a wearable pocket (6) with a magnet (7) that is sewn (8) into the pocket. The sewn portion (8) can be square in shape and allow for flipping the magnet (such as a round one) inside the sewn compartment to obtain the correct polarity for the magnet (7) for attachment to magnet (5) of the button (1). The body (9) of the pocket in this embodiment is a pocket with a semi-circular bottom and a substantially trapezoid top. The pocket (6) is closed on all sides and open on top for placement of objects.

Figure 4:
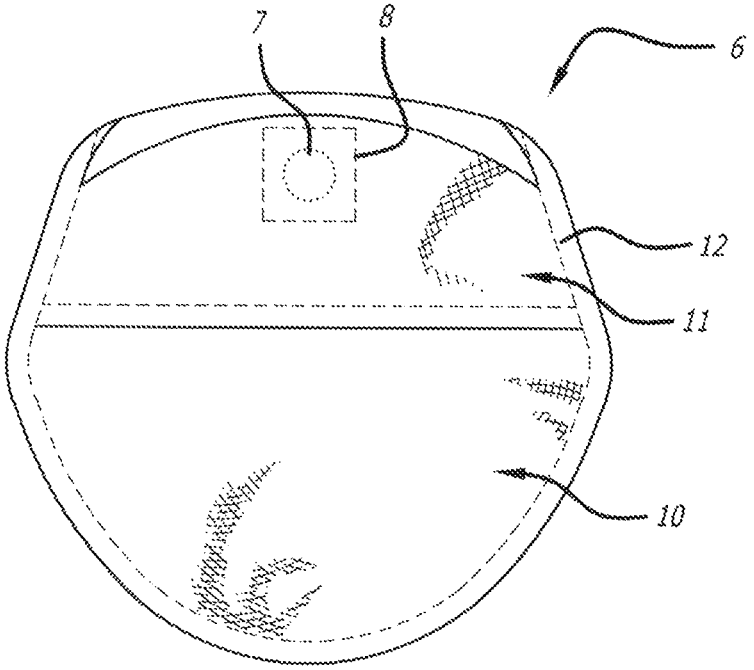
FIG. 4 illustrates a front view of the wearable pocket that is inside out.

FIG. 4 illustrates the pocket of FIG. 3 inside-out. FIG. 4 illustrates a wearable pocket (6) with a magnet (7) that is sewn (8) into the body of the pocket (10). A top portion of the pocket (11) has been turned over and sewn to the sides (12). The magnet (7) is sewn in between the layer formed by turning over the top (11).

Figure 5:
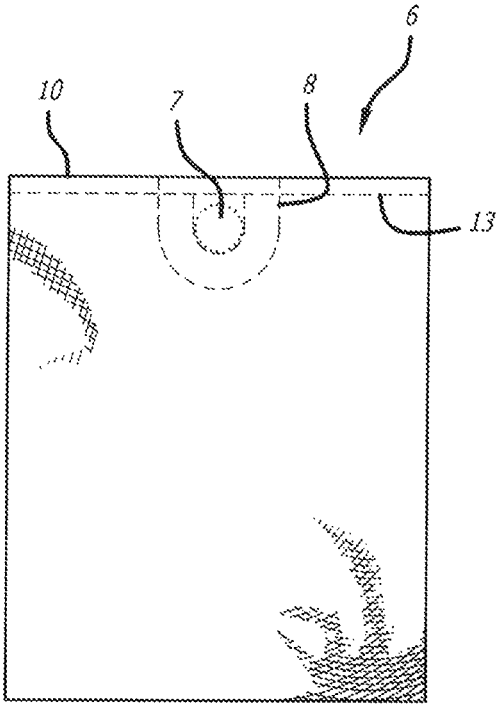

FIG. 5 illustrates the pocket (6) with magnet (7) sewn (8) into a round compartment. Also illustrated are sewn lines (13) that go from one side to other side of the pocket. The pocket (6) illustrated in this figure is rectangular in shape and suitable for placement of objects such as credit cards and passports.

FIG. 6 illustrates a person wearing the pocket (6) under a shirt (15). The button (1) is visible on the outside and the pocket (6) is not visible. The button (1) and the pocket (6) are held together with a magnetic connection through the fabric.

FIG. 7 illustrates a cut-off side view of the wearable pocket of FIG. 6. In this embodiment, the user is wearing the pocket (6) with the magnet (7) facing the button. In another embodiment, a user can wear the pocket (6) with magnet (7) facing the user, allowing the magnetic connection to seal the pocket (6). The magnetic connection is made through fabric (15). The magnet (7) is sealed by the pocket (8, 11) in a compartment that allows the magnet to be flipped to obtain the correct polarity.

The present invention also provides a kit with the button (1) and wearable pocket (6) in a package for sale to a customer. The customer puts the pocket (6) inside his or her clothing, such as a shirt (15), and then puts the button (1) on the outside to form a magnetic connection. The customer can keep any suitable object in the pocket (6), such as objects having a weight of 1 to about 30 grams, such s about 5 to about 15 grams. Examples of objects include cigarettes, condoms, pills, money, credit card, notes, and papers. If the polarity of the magnets (7, 5) do not match, the customer can flip magnet (7) to match the polarity. The sewing (8) on the pocket provides a compartment with sufficient space to flip the magnet to match the polarity.

The magnet (5, 7) can be a suitable strength disc shaped magnet having a strength of 30-50 (such as N40). During manufacturing, the magnets are made to have correct polarity. If correct polarity is not obtained, a user can flip the magnet to obtain correct polarity (plus/minus).

The pocket (6) can be made from any suitable fabric, such as cotton, synthetic (polyester, lace) or mixtures. The pocket can be made of a net to reduce cost.

The pocket (6) and the button (1) can be sold in a package or a kit as a combination. The package is typically a retail package that a consumer can take home. The package can be a box having a transparent section that allows a consumer to look inside the package. A customer would open the package, place an object inside the pocket, put the pocket inside her clothing, and put the button on the outside.

The dimensions of the pocket (6) can be any suitable dimensions for carrying objects, such as about 5 centimeters (CM) to about 9 (CM) inches long (vertical), and about 5 (CM) to about 7 (CM) wide (at widest location).

The pocket (6) can be manufactured in different manners. In one embodiment, the pocket is made from a piece of fabric that is folded to create a bottom, two sides, and a top, with the two sides sewn, and the top flipped over and sewn to create a compartment for placement of the second magnet. In another embodiment, instead of flipping over the top to create the compartment, an additional piece of fabric is sewn over the pocket on the inside of the pocket to hold the magnet (7) as illustrated in FIG. 5.

The magnet (7) can be surrounded with a fusing. The fusing is a layer of material that is attached to the inside of the fabric facing the magnet (7) to secure the magnet in the compartment and not allow the magnet (7) to fall out if the fabric weakens. The fusing strengthens the fabric. The fabric and/or at least top portion of fabric (16) (portion facing compartment) can have a layer of fusing. If the fabric (16) is lace, fusing can be attached to both sides. For other fabric types, fusing may only need to be attached to the fabric inside. The fusing can be attached to the fabric by ironing.

REFERENCES

Button (1)
Button Body (front) (2)
Design element (3)
Button back (4)
Button magnet (5)
Wearable pocket (6)
Pocket magnet (7)
Square sewn (8)
Outside of pocket (9)
body of the pocket (10)
top of the pocket (11)
sewn to the sides (12)
sewn lines (13)
raised disc (14)
clothing (15)

What is claimed is:

1. A package comprising:

a) a button with a design element having a first round magnet for placing outside of an article of clothing; and b) a wearable pocket closed on a bottom, a left side and a right side and having an opening at a top; the pocket comprising a front portion facing a user and a back portion facing the article of clothing, with a second round magnet for placing inside of the clothing in the front portion facing the user;

wherein the button has a side facing the pocket, the side of the button facing the pocket having a raised disc with a cavity inside for placing the first round magnet inside of the cavity of the raised disc;

wherein the first and the second magnet form a magnetic connection through the clothing to maintain the button and the wearable pocket on the clothing, and close the opening at the top of the pocket with the magnetic connection;

wherein the user can remove the pocket by breaking the magnetic connection between the first and the second magnet.

2. The package of claim 1, wherein the clothing is a shirt, dress, jacket, or skirt.

3. The package of claim 1, wherein the pocket has a sewn compartment for placement of the second magnet.

4. The package of claim 3, wherein the compartment has sufficient space to allow for the second magnet to be flipped.

5. The package of claim 3, wherein the compartment is square in shape.

6. The package of claim 1, wherein the pocket has an opening solely at its top.

7. This package of claim 1, wherein the pocket is made from a piece of fabric that is folded to create a bottom, two sides, and a top, with the two sides sewn, and the top flipped over and sewn to create a compartment for placement of the second magnet.

8. This package of claim 1, wherein the second magnet is held in place by sewing a piece of fabric on the pocket to create a compartment for the second magnet.

9. This package of claim 1, wherein at least a portion of the pocket holding the second magnet is made from a fabric with fusing.

* * * * *